US007530578B2

(12) United States Patent
Niemeyer et al.

(10) Patent No.: US 7,530,578 B2
(45) Date of Patent: May 12, 2009

(54) STEP-ON RECEPTACLE WITH TIP PREVENTION

(75) Inventors: Duane Niemeyer, Aviston, IL (US); Mickey Haggin, Eureka, MO (US); Robert Wareheim, St. Charles, MO (US); Tom Dickinson, St. Louis, MO (US)

(73) Assignee: Continental Commercial Products, LLC, Bridgeton, MO (US)

( * ) Notice: Subject to any disclaimer, the term of this patent is extended or adjusted under 35 U.S.C. 154(b) by 509 days.

(21) Appl. No.: 10/990,732

(22) Filed: Nov. 17, 2004

(65) Prior Publication Data

US 2006/0103086 A1 May 18, 2006

(51) Int. Cl.
*B62B 1/00* (2006.01)

(52) U.S. Cl. ..... 280/47.26; 220/262; 220/263; 220/264

(58) Field of Classification Search ..... 280/47.26; 220/262, 263, 264, 908
See application file for complete search history.

(56) References Cited

U.S. PATENT DOCUMENTS

| | | | |
|---|---|---|---|
| 396,972 | A | 1/1889 | Anderson |
| 816,886 | A | 4/1906 | Shonnard |
| 963,079 | A | 7/1910 | Sebring |
| 970,960 | A | 9/1910 | Seymour |
| 1,012,346 | A | 12/1911 | Fraser |
| 1,028,698 | A | 6/1912 | Farling |
| 1,039,050 | A | 9/1912 | Grubb et al. |
| 1,053,688 | A | 2/1913 | Willcox |
| 1,131,774 | A | 3/1915 | Davis |
| 1,131,847 | A | 3/1915 | Lucas |
| 1,135,810 | A | 4/1915 | Jones |
| 1,137,355 | A | 4/1915 | Schell |
| 1,176,046 | A | 3/1916 | Foldeak |
| 1,195,566 | A | 8/1916 | Davis |
| 1,215,026 | A | 2/1917 | Hull |
| 1,218,632 | A | 3/1917 | Derry |
| 1,229,777 | A | 6/1917 | Oberholtzer |
| 1,236,429 | A | 8/1917 | Hansen |
| 1,247,058 | A | 11/1917 | Zifferer |

(Continued)

FOREIGN PATENT DOCUMENTS

| | | |
|---|---|---|
| CH | 676835 | 3/1991 |

(Continued)

OTHER PUBLICATIONS

Rubbermaid, specification sheet for Step-On Container, Jul. 29, 2003, 2 pages, www.rcpworksmarter.com.

(Continued)

*Primary Examiner*—Christopher P Ellis
*Assistant Examiner*—Katy Meyer
(74) *Attorney, Agent, or Firm*—Thompson Coburn LLP; Joseph M. Rolnicki, Esq.

(57) ABSTRACT

A novel construction of a stabilized receptacle is provided in which the receptacle is comprised of only seven separate component parts that are assembled together without the use of separate threaded fasteners. In addition, the receptacle is provided with a stabilizing hoop that extends forwardly from the receptacle around the foot pedal of the receptacle and stabilizes the receptacle, preventing movement of the receptacle when the foot pedal is depressed.

10 Claims, 4 Drawing Sheets

U.S. PATENT DOCUMENTS 1,352,495 A 9/1920 Zifferer
1,365,686 A 1/1921 Harvey
1,381,390 A 6/1921 Zifferer
1,479,634 A 1/1924 Toscan
1,507,040 A 9/1924 Zifferer
1,509,798 A 9/1924 Vance et al.
1,550,732 A 8/1925 May et al.
1,561,444 A 11/1925 Smith
1,580,880 A 4/1926 Frisbie
1,601,930 A 10/1926 Suddendorf
1,634,876 A 7/1927 Marcus
1,639,992 A 8/1927 Geibel
1,645,100 A 10/1927 Geibel
1,651,220 A 11/1927 Nelson
1,677,048 A 7/1928 Pfeffer
1,699,220 A 1/1929 Boykin
1,703,509 A 2/1929 Chandlee
1,714,332 A 5/1929 Ullrich
1,754,802 A 4/1930 Raster
1,763,756 A 6/1930 Casapollo
1,791,766 A 2/1931 Scharf
1,820,554 A 8/1931 Buschman
1,820,555 A 8/1931 Buschman
1,891,651 A 12/1932 Padelford et al.
1,908,235 A 5/1933 Geibel
1,917,298 A 7/1933 Hammer
1,922,729 A 8/1933 Geibel
1,938,013 A 12/1933 Folsom et al.
1,939,139 A 12/1933 Schott
1,948,413 A 2/1934 Carola
1,966,323 A 7/1934 Von Elm
1,980,938 A 11/1934 Geibel
2,001,445 A 5/1935 Abele
2,041,038 A 5/1936 Wisner
2,046,777 A 7/1936 Geibel
2,071,486 A 2/1937 Wright
2,096,506 A 10/1937 Brandstrom
2,106,892 A 2/1938 Kamenstein
2,120,520 A 6/1938 Kamenstein
2,216,279 A 10/1940 Packer
2,242,698 A 5/1941 Evitt
2,308,326 A 1/1943 Calcagno
2,311,835 A 2/1943 Johnson
2,348,349 A 5/1944 Lumley
2,419,163 A 4/1947 Pope, Sr.
2,456,840 A 12/1948 Rogers et al.
D153,443 S 4/1949 Moore
2,475,125 A 7/1949 Brownell
2,527,449 A 10/1950 Poole et al.
2,532,165 A 11/1950 Hermani
2,563,456 A 8/1951 Brownell
2,593,455 A 4/1952 James
2,615,663 A 10/1952 Hamilton
2,634,074 A 4/1953 Von Allmen
2,663,529 A 12/1953 Lyttaker
2,811,329 A 10/1957 Press et al.
2,910,206 A 10/1959 Hodgson
2,946,474 A 7/1960 Knapp
D191,546 S 10/1961 Gamer
3,008,604 A 11/1961 Garner
3,450,297 A 6/1969 Clerk
3,825,215 A 7/1974 Borglum
3,831,838 A 8/1974 Kline et al.
D241,499 S 9/1976 Raftery
4,081,105 A 3/1978 Dagonnet et al.
4,119,240 A 10/1978 Dumas et al.
4,150,764 A 4/1979 Anderson
D261,720 S 11/1981 Brazis
4,300,696 A 11/1981 Bryce
4,303,174 A 12/1981 Anderson
RE30,875 E 3/1982 Anderson
4,363,417 A 12/1982 Rhoades et al.
4,445,619 A 5/1984 Kubic et al.
D284,320 S 6/1986 Kubic et al.
4,593,873 A 6/1986 Nelson
D288,019 S 1/1987 Gebhard et al.
4,785,964 A 11/1988 Miller et al.
4,865,214 A 9/1989 Koda et al.
4,892,218 A 1/1990 Reiling
4,913,308 A 4/1990 Culbertson
4,953,740 A 9/1990 Koda
4,972,966 A 11/1990 Craft, Jr.
5,011,036 A 4/1991 Souza et al.
D319,905 S 9/1991 Hotchkiss
5,048,712 A 9/1991 Wolters
D322,350 S 12/1991 Craft, Jr. et al.
5,125,526 A 6/1992 Sumanis
D329,929 S 9/1992 Knoedler et al.
5,147,055 A 9/1992 Samson et al.
5,147,056 A 9/1992 Ma
5,163,574 A 11/1992 Sosan
5,163,579 A 11/1992 Jones
D332,852 S 1/1993 Delmerico
5,195,649 A 3/1993 Wolters
5,230,525 A 7/1993 Delmerico et al.
5,249,693 A 10/1993 Gillispie et al.
5,348,222 A 9/1994 Patey
5,350,079 A * 9/1994 Larson et al. ..... 220/264
5,372,271 A 12/1994 Miller et al.
5,385,259 A 1/1995 Bernstein et al.
5,440,978 A 8/1995 O'Brien et al.
5,474,201 A 12/1995 Liu
D368,563 S 4/1996 Brightbill et al.
5,531,348 A 7/1996 Baker et al.
5,535,913 A 7/1996 Asbach et al.
D380,114 S 6/1997 Albright
D381,784 S 7/1997 Keller et al.
5,655,680 A 8/1997 Asbach et al.
5,671,859 A 9/1997 Sheu et al.
5,758,888 A 6/1998 Burgan et al.
D401,028 S 11/1998 Ahern, Jr. et al.
5,881,896 A 3/1999 Presnell et al.
D415,327 S 10/1999 Primeau
6,000,569 A 12/1999 Liu
6,010,024 A 1/2000 Wang
6,024,238 A 2/2000 Jaros
D422,123 S 3/2000 Roudebush
6,102,343 A 8/2000 Grimesey et al.
D431,700 S 10/2000 Roudebush
6,196,407 B1 3/2001 Liu
6,209,744 B1 4/2001 Gill
6,345,725 B1 2/2002 Lin
6,386,386 B1 5/2002 George
6,390,321 B1 5/2002 Wang
D465,630 S 11/2002 Lin
D465,894 S 11/2002 Lin
D466,265 S 11/2002 Lin
D466,667 S 12/2002 Lin
D467,696 S 12/2002 Rashid
D470,639 S 2/2003 Quan
D476,128 S 6/2003 Lin
D476,460 S 6/2003 Lin
2001/0020619 A1 9/2001 Pfeifer et al.
2002/0027140 A1 3/2002 George
2002/0079315 A1 6/2002 Yang
2002/0092853 A1 7/2002 Wang
2002/0158068 A1 10/2002 Panek, Jr.
2004/0206758 A1 * 10/2004 Lin

FOREIGN PATENT DOCUMENTS

CH 676836 3/1991
DE 4014468 4/1991
EP 0 313 266 10/1988

| | | |
|---|---|---|
| FR | 2612156 | 9/1988 |
| FR | 2694922 | 2/1994 |
| FR | 2817541 | 6/2002 |
| GB | 2 065 455 | 7/1981 |
| GB | 2 205 730 | 12/1988 |
| GB | 2 241 425 | 9/1991 |
| GB | 2 252 316 | 8/1992 |
| GB | 2 290 943 | 1/1996 |
| GB | 2 323 019 | 9/1998 |
| JP | 3212357 | 11/1990 |
| JP | 4345407 | 12/1992 |
| JP | 5105203 | 4/1993 |
| JP | 6219504 | 8/1994 |
| JP | 7041105 | 2/1995 |
| JP | 8053202 | 2/1996 |
| JP | 8108901 | 4/1996 |
| JP | 8169503 | 7/1996 |
| JP | 8198292 | 8/1996 |
| JP | 8301326 | 11/1996 |
| JP | 9202402 | 8/1997 |
| JP | 9301398 | 11/1997 |
| JP | 10059506 | 3/1998 |
| JP | 10203602 | 8/1998 |
| JP | 10218215 | 8/1998 |
| JP | 10245056 | 9/1998 |
| JP | 11227813 | 8/1999 |
| JP | 2002274601 | 9/2002 |
| JP | 2003112755 | 4/2003 |
| JP | 2003112806 | 4/2003 |
| JP | 6219504 | 8/2004 |
| WO | WO 92/02430 | 2/1992 |

OTHER PUBLICATIONS

Rubbermaid, specification sheet for Mobile Step-On Container, Jul. 29, 2003, 2 pages, www.rcpworksmarter.com.

* cited by examiner

STEP-ON RECEPTACLE WITH TIP PREVENTION

FIELD OF THE INVENTION

This invention relates generally to receptacles for containing articles and, more particularly, to receptacles that include foot pedals for opening a lid of the receptacle.

BACKGROUND OF THE INVENTION

"Step-on receptacles" are used to contain articles that the user typically considers to be debris or refuse. These receptacles include a hollow body, a lid covering the top of the hollow body, and a foot pedal operably connected to the lid so that when a user steps on the pedal the lid opens. In locations in which biologically hazardous materials (i.e. biohazards) may be encountered, step-on receptacles allow a user to hold an article while operating the lid with a foot so that the user can deposit the article in the receptacle without using either hand. Because the user can operate the receptacle in a "hands-free" manner, the user can deposit articles in the receptacle without potentially spreading foreign matter between the receptacle, the article, and the user's gloves.

Since the pedal extends from the front of the receptacle, the pedal creates a moment arm relative to the center of gravity of the receptacle. When the user steps on the pedal, the force applied to the pedal tends to cause the receptacle to tip over because of this moment arm. The resulting instability negates the advantage of the hands-free operation because the user often steadies the receptacle with their hand(s) to prevent it from tipping. In an attempt to overcome the instability, many receptacle providers configure the receptacles so that they will settle in an upright position even if tipped by as much as 22 degrees from the receptacle's upright position. However, the tipping movement of the receptacle will still cause many users to steady the receptacle with their hand(s) despite the likelihood that the receptacle will return to its upright position.

The pedal itself aggravates the tipping problem because the pedal requires a long stroke of pedal movement to minimize the amount of force necessary to lift the weight of the lid. Thus, previous receptacles generally elevate the bottom surface of the article-containing hollow body to provide adequate clearance underneath the receptacle bottom surface for the pedal movement. These receptacles elevate the center of gravity of the receptacle by the entire stroke movement of the pedal. Not only does the elevation of the center of gravity aggravate the tipping problem in the direction toward the pedal, but, the elevation also aggravates the tendency of these receptacles to tip toward either side and even backwards.

Thus, a need exists for step-on receptacles that remain stable when the user operates the pedal.

SUMMARY OF THE INVENTION

It is in view of the above problems that the present invention was developed. The invention provides a step-on receptacle of simplified construction that remains stable during the lid lifting operation of the foot pedal.

In a first preferred embodiment, the present invention provides a refuse receptacle with a lid and a foot pedal placed near a bottom member of the receptacle. The foot pedal opens the lid when a user steps on the pedal. The refuse receptacle of the current embodiment also includes a wire hoop protruding from the front of the receptacle and surrounding the foot pedal. With the receptacle positioned upright on a surface, the hoop is positioned beneath the foot pedal and slightly above the surface. If a user exerts too much force when stepping on the pedal, the hoop engages against the surface and prevents the receptacle from tipping over. Optionally, the hoop may attach to the receptacle without fasteners by, for example, being expanded at an open end of the hoop and slipped over an attachment structure on the receptacle, thus simplifying the receptacle's construction.

In another preferred embodiment, the present invention provides a receptacle that includes a bottom member, a plurality of sidewalls, a top cover, a lever, and a support. The sidewalls extend upwardly from the bottom member and surround a top opening of the receptacle. The top cover attaches to an upper end of one of the sidewalls. When the top cover is in a closed position, it is positioned adjacent the upper ends of the sidewalls and covers over the top opening. When the top cover is in its opened position it is displaced from the top opening and extends upwardly from the one sidewall. Preferably, the top cover is a lid that pivots between the opened and closed positions when a downward force is applied to the lever. Applying force to the lever, though, causes the receptacle to tend to rotate (i.e. tip over). To prevent the receptacle from tipping over, the support is attached to the receptacle via an aperture defined by the receptacle. A portion of the support abuts the receptacle along either the bottom member or along a rib on the bottom of the receptacle. Another portion of the support extends from the receptacle in the same direction in which the lever extends from the receptacle. In a preferred embodiment, the receptacle is a bio-hazard container and has a foot pedal.

In a third preferred embodiment, the present invention provides a method of containing articles. The method includes applying a force to a lever that is operably connected to a receptacle for containing articles. The force on the lever moves a top cover of the receptacle from a closed position to an opened position and tends to cause the receptacle to tip over. The receptacle also has a bottom member and a plurality of sidewalls extending from the bottom member. In the closed position the top cover is substantially adjacent the upper ends of the sidewalls. In the opened position an edge of the top cover is spaced apart from an upper end of at least one of the sidewalls. Additionally, the method includes resisting the tendency of the receptacle to tip over with a support that extends from the receptacle and that abuts the receptacle along at least a portion of the support.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate exemplary embodiments of the present invention and together with the description, serve to explain the principles of the invention. In the drawings.

DETAILED DESCRIPTION OF THE PREFERRED EMBODIMENTS

Figure 1:
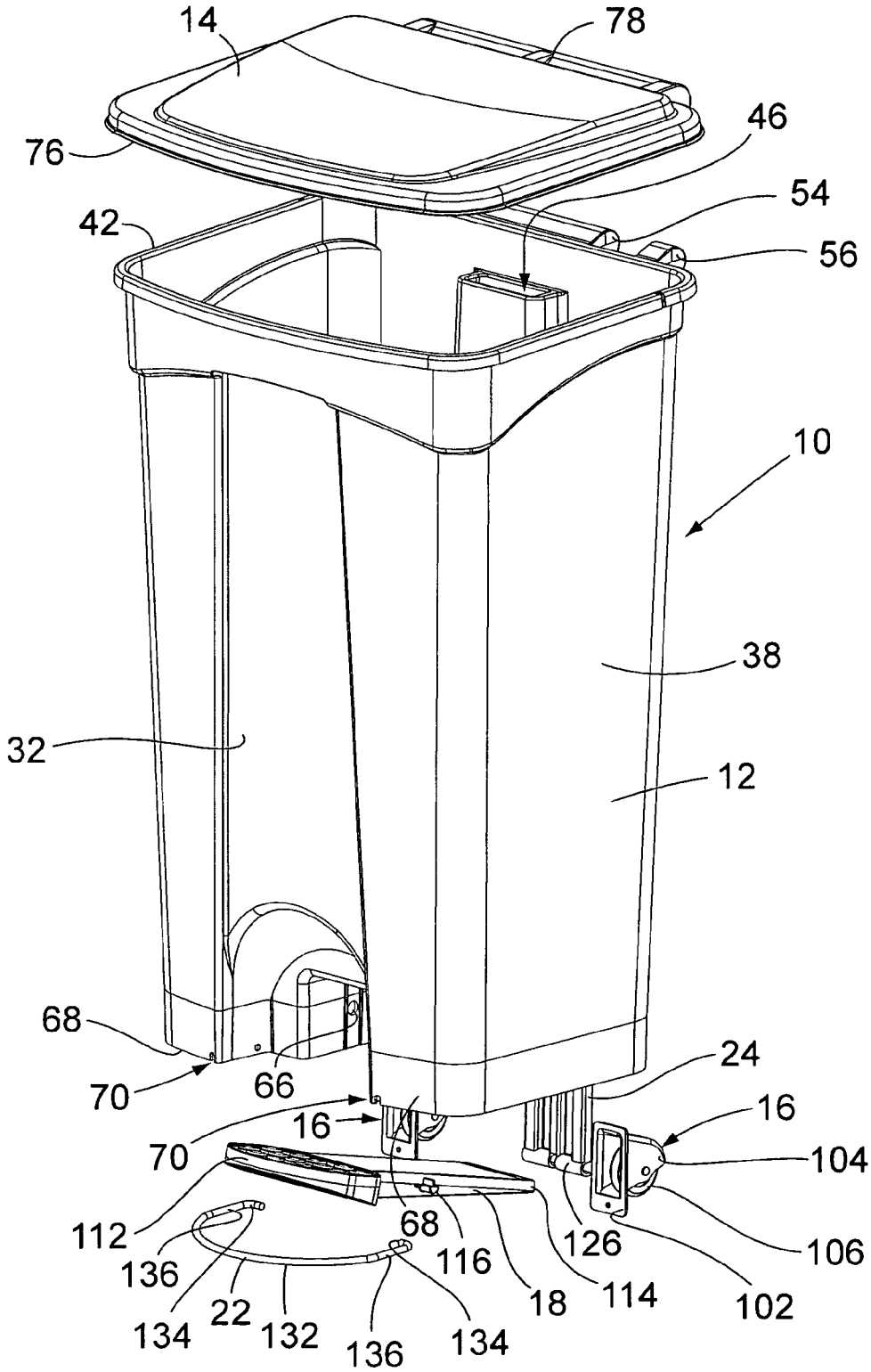
FIG. 1 is a front perspective exploded view of a step-on receptacle constructed in accordance with the principles of the present invention.

The receptacle 10 of the invention has a novel, simplified construction that enables the receptacle 10 to be constructed of only seven basic component parts. Preferably all of these parts, except one, is constructed of a plastic material. It is preferred that each of the parts be formed monolithically. Furthermore, the simplified construction of the receptacle 10 enables the component parts of the receptacle to be assembled together without the use of separate threaded fasteners, such as screws or nuts and bolts, if so desired. The seven component parts include a hollow receptacle housing 12, a lid 14 that is attached to the housing, a pair of wheel assemblies 16 that are attached to the housing, an actuator foot pedal 18 that is attached to the housing, a stabilizing hoop 22 that is attached to the housing, and an actuator link 24 that is attached between the foot pedal 18 and the lid 14.

The receptacle housing 12 has a construction that is similar to that of prior art receptacle housings. It is comprised of a bottom wall 28 and a plurality of side walls that extend upwardly from the bottom wall. The side walls include a front wall 32, a rear wall 34, and opposite left 36 and right 38 side walls. Each of these side walls extends upwardly from the receptacle bottom wall 38 to a top peripheral edge 42 of the receptacle. This top edge 42 of the receptacle surrounds an access opening to the interior volume of the receptacle.

Figure 3:
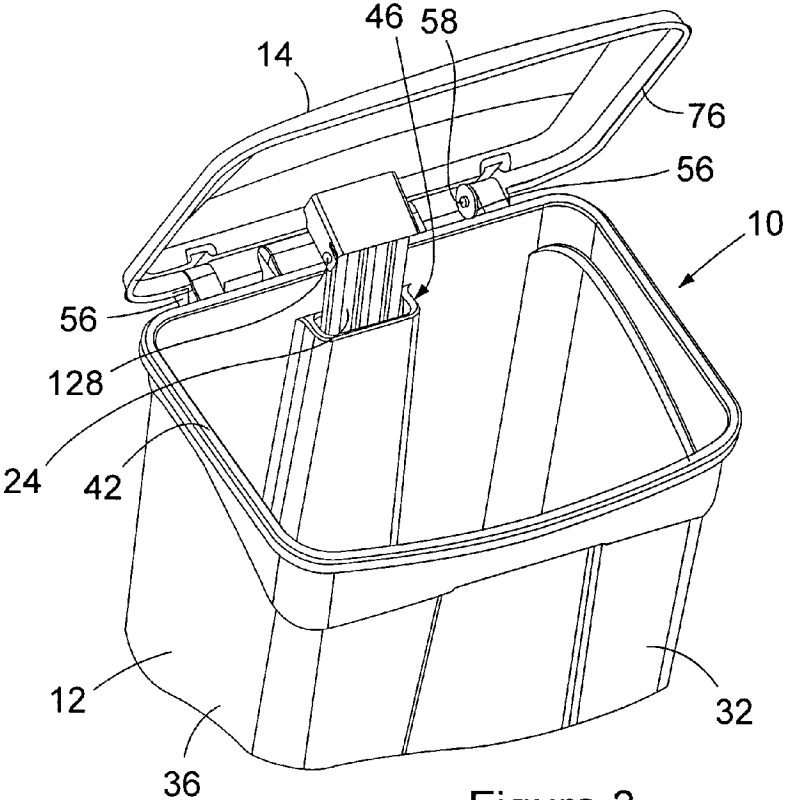
FIG. 3 is a partial perspective view of the top of the receptacle.
Figure 2:
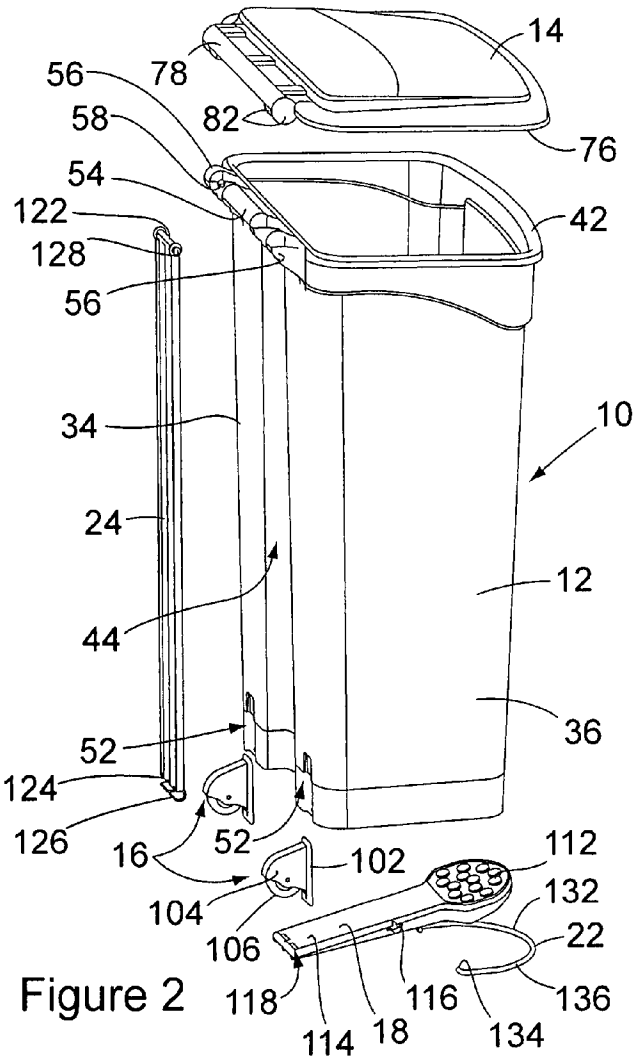
FIG. 2 is a rear perspective exploded view of the receptacle of FIG. 1.

As shown in FIGS. 2 and 3, the receptacle rear wall 34 is constructed with a recess 44 formed into the rear wall. The recess 44 forms a recessed channel that extends from the receptacle bottom wall 28 upwardly across the receptacle rear wall 34, but ends short of the receptacle peripheral edge 42. As shown in FIG. 3, the recessed channel 44 has an opening 46 at its top end that opens into the interior volume of the receptacle 10.

The receptacle rear wall 34 also has a pair of slots 52 formed into the rear wall at the bottom of the receptacle. The slots 52 are formed as part of a tongue and groove connection that connects the wheel assembly 16 to the receptacle 10, as will be explained.

Figure 4:
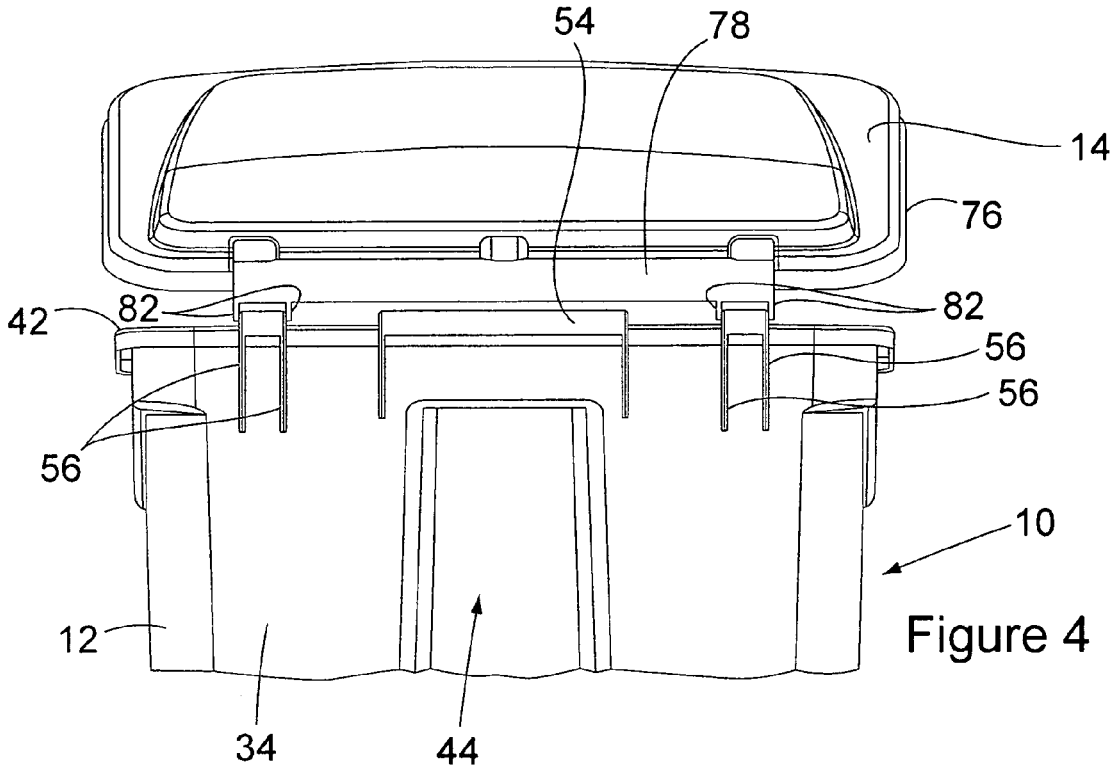
FIG. 4 is a partial view of the rear of the receptacle.

The top edge of the receptacle rear wall 34 is shown in FIG. 4. A handle 54 is formed in the middle of the rear wall 34 at the top edge. The handle 54 is used in transporting the receptacle. Just outside of the handle are pairs of reinforcing gussets 56 formed on the rear wall 34 at the rear wall top edge. These pairs of gussets 56 project outwardly, away from the rear wall 34 at the rear wall top edge. A lid pin 58 projects inwardly from each of the pair of gussets 56. Each lid pin 58 has a champhered or tapered surface portion at the top of the pin. This tapered surface portion is used in attaching the lid 14 to the receptacle 10, in a manner to be explained.

Figure 5:
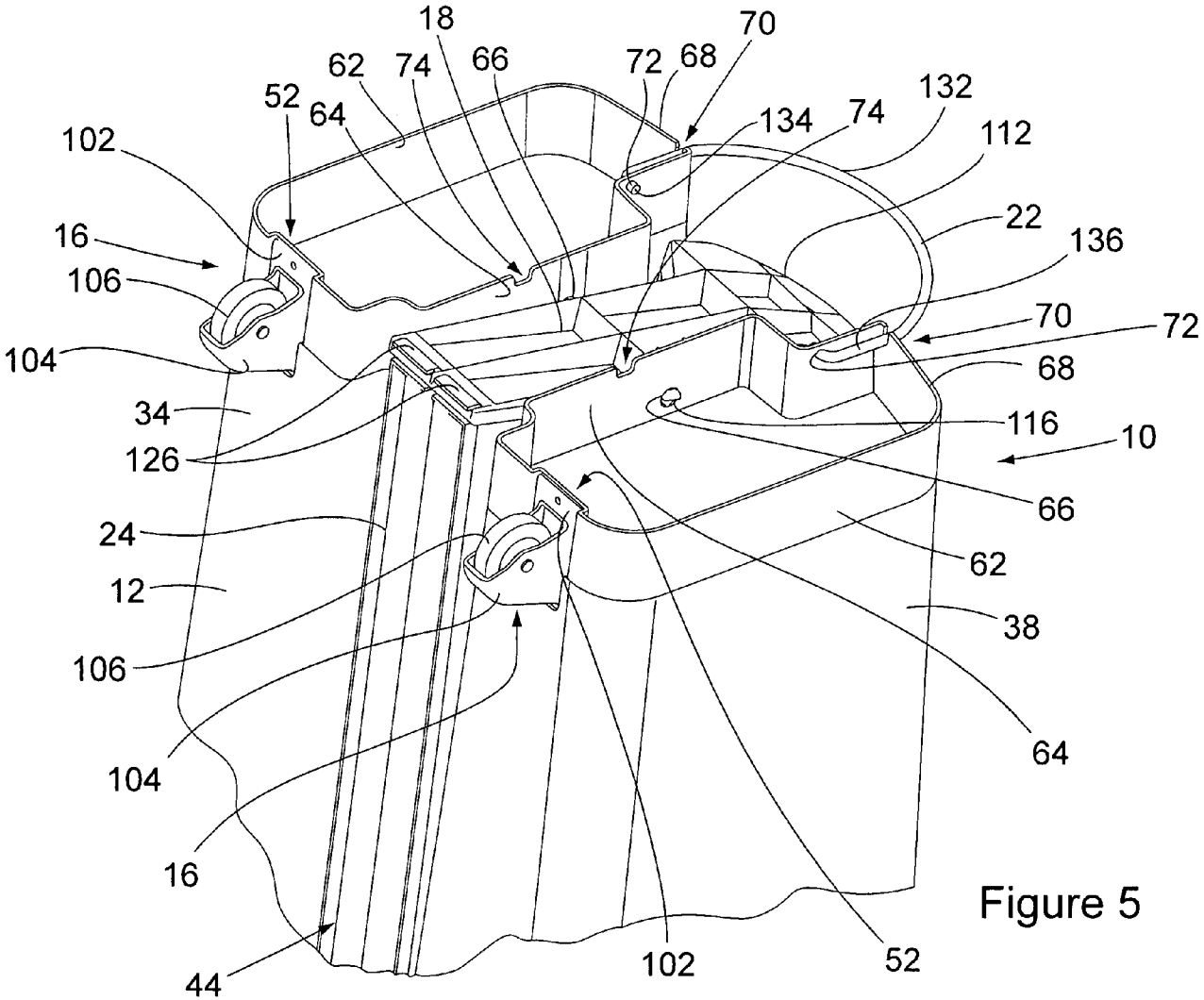
FIG. 5 is a partial view of the bottom of the receptacle.

FIG. 5 shows the underside of the receptacle bottom wall 28. As shown in FIG. 5, the receptacle bottom wall 28 is formed with a pair of flange assemblies 62 that project downwardly from the bottom wall 28 and circuit around opposite sides of the bottom wall. The flange assemblies 62 provide reinforcement to the bottom wall. Intermediate flange portions 64 of the flange assemblies 62 extend parallel to each other across the receptacle bottom wall 28. The spacing between the intermediate flange portions 64 forms a through slot beneath the receptacle bottom wall 28 that extends from the receptacle front wall 32 through to the receptacle rear wall 34. Axially aligned pivot pin holes 66 are formed in each of these flange portions 64. Toward the receptacle front wall 32, the flange portions angle outwardly to a pair of parallel, forward flange portions 68. A pair of axially aligned support holes 72 are formed in the forward flange portion 68. A pair of support notches 70 are formed in the bottom edges of portions of the flanges 62 that are flush with the receptacle front wall 32. As seen in FIG. 5, the notches 70 are formed in the bottom wall flanges 62 just outside of the forward flange portions 68. An additional pair of storage flange notches 72 are formed in the bottom edges of the intermediate flange portions 64.

Figure 6:
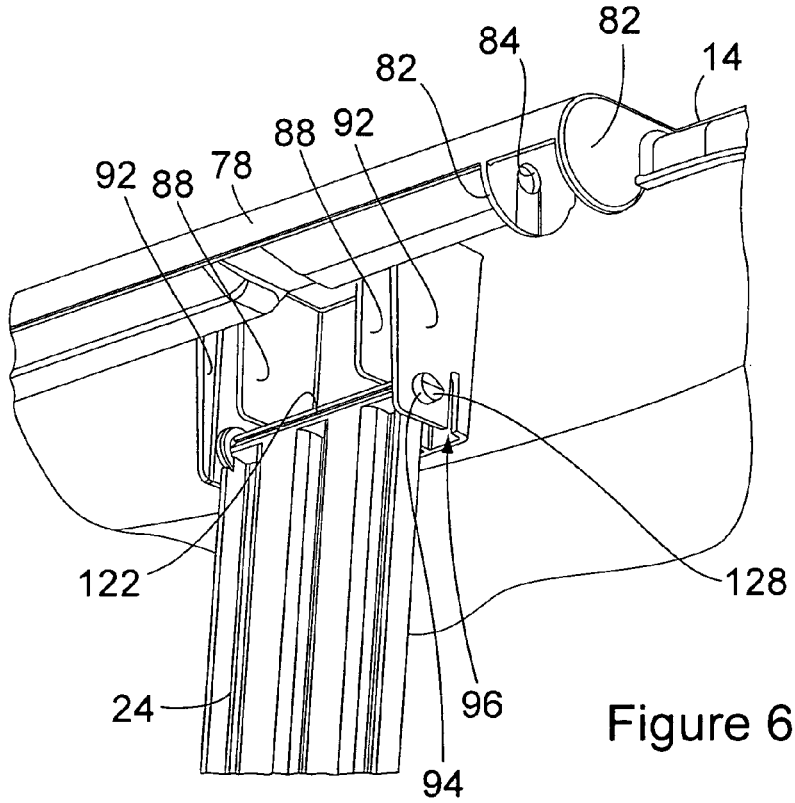
FIG. 6 is a partial view of the interior of the receptacle.

The lid 14 is configured and dimensioned so that an outer peripheral edge 76 of the lid extends over and outside the top edges 42 of the receptacle side walls covering over the opening to the receptacle interior. The configuration of the lid 76 enables it to fit snug over the receptacle side wall top edges 42 when the lid is positioned on the receptacle. An attachment bar 78 extends across a rearward portion of the lid peripheral edge 76. As shown in FIGS. 3, 4, and 6, pairs of attachment flanges 82 extend downwardly from the opposite ends of the lid attachment bar 78. The innermost flange of each pair of flanges 82 is provided with a pivot pin hole 84. The spacing between each pair of flanges 82 is such that they can be positioned over the opposite sides of the pairs of gussets 56 that project outwardly from the receptacle rear wall 34. The pairs of flanges 82 are resilient so that the flanges can be pushed downwardly onto the pairs of gussets 56 and the tapered surfaces of the gusset pins 58 will cause the inner most flanges 82 to bend toward each other. This enables the lid flanges 82 to be pushed downwardly to the extent that the gusset pins 58 will engage in the lid flange holes 84, thus attaching the lid 82 to the top of the receptacle 10 for pivoting movement of the lid between an opened and closed position of the lid relative to the receptacle.

FIG. 6 also shows a pair of abutment flanges 88 and a pair of attachment flanges 92 that extend downwardly from the underside of the lid 14. As shown in FIG. 6, the attachment flanges 92 extend downwardly to a greater extent from the lid 14 than do the abutment flanges 88. In addition, each of the attachment flanges 92 has a hole 94 and a slot 96 formed in the flange at its bottom end. The slot 96 enables the bottom portion of the attachment flange 92 in the area of the hole 94 to be flexed resiliently outwardly. This is employed in attaching the actuator link 24 to the lid 14, in a manner to be explained.

The wheel assemblies 16 each include a base 102 having a configuration designed to enable the base to slide into the wheel slots 52 in the rear wall 34 of the receptacle housing 12. Preferably, a tongue and groove connection is provided between each wheel assembly base 102 and the receptacle wheel slot 52. This enables each wheel assembly 16 to be secured to the receptacle housing 12 without the use of additional fasteners, for example screws or nut and bolt fasteners. However, screws could be used to secure the wheel assembly bases 102 in the receptacle rear wall slots 52 if so desired. A shroud 104 projects outwardly from each wheel assembly base 102. A wheel 106 is mounted inside each shroud 104 for rotation of the wheel. The position of the wheel assembly 16 at the bottom of the housing receptacle rear wall 34 enables the entire receptacle 10 to be pivoted onto the wheels 106 by pulling back on the rear wall handle 54 to transport the receptacle.

The foot pedal 18 has a length with an opposite forward end 112 and rearward end 114. The top surface of the foot pedal forward end 112 is textured to provide a non-slip surface. The length of the foot pedal 18 is dimensioned to be received in the through slot defined by the intermediate flange portions 64 on the receptacle bottom wall 28. A pair of pivot pins 116 project outwardly from opposite sides of the foot pedal 18 at an intermediate position of the foot pedal between its forward end 112 and its rearward end 114. The pivot pins 116 are inserted into the foot pedal pivot pin holes 66 provided in the intermediate flange portions 64. In this position the foot pedal forward end 112 projects outwardly from the receptacle front wall 32. This mounts the foot pedal 18 for pivoting movement in the through slot of the receptacle defined by the intermediate flange portions 64 on the receptacle bottom wall 28. The pivoting movement of the foot pedal 18 moves the foot pedal forward end 112 between a raised position and a lowered position relative to the receptacle housing 12. This in turn moves the foot pedal rearward end 114 between a respective lowered position and a raised position relative to the receptacle housing 12. The length of the foot pedal 18 positions the foot pedal rearward end 114 just below the recessed channel 44 in the receptacle rear wall 34. A pair of slots 118 are provided in the foot pedal 18 adjacent the foot pedal rearward end 114.

The actuator link 24 has an elongate, straight configuration with a top end 122 and opposite bottom end 124. The length of the link 24 is constructed with reinforcing ribs that extend along the length so that the link, although preferably constructed of a plastic material, is relatively rigid along the length of the link. The link bottom end 124 is constructed with a pair of hooks 128 that engage in the foot pedal slots 118 to operatively connect the link with the foot pedal. The hooks 126 provide a direct connection between the link 24 and the foot pedal 18 without the use of additional parts or fasteners. As shown in FIGS. 2 and 6, a pair of pivot pins 128 project outwardly from opposite side edges of the link 24 at the link top end 122. Each of the link pins 128 has a tapered top surface as shown in FIG. 6. As the link 24 extends upwardly from the foot pedal 18, the length of the link extends through the length of the channel 44 recessed into the receptacle housing rear wall 34. The length of the link 24 extends upwardly through the top opening 46 of the recessed channel 44 and into the interior volume of the receptacle housing 12. The link top end 122 extends between the pair of lid attachment flanges 92. In attaching the link top end 122 to the lid 14, the link pins 128 are pushed upwardly between the pair of lid attachment flanges 92 causing these flanges to flex outwardly. This is assisted by the tapered top surfaces of the link pins 128. The link top end 122 is continued to be pushed upwardly between the pair of lid attachment flanges 92 until the link pins 128 engage in the holes 94 in the lid attachment flanges 92. The link pins 128 provide a direct connection between the link 24 and the lid 14 without the use of additional parts or fasteners. This operatively connects the link 24 with the lid 14 with the link top end 122 abutting the lid abutment flanges 88.

It can be seen that, through the operative connection of the link 24 with the foot pedal 18 and the lid 14 described above, that the weight of the lid 14 on the top of the receptacle housing 12 will push the link 24 downwardly on the foot pedal rearward and 114. This causes pivoting of the foot pedal and raising the foot pedal forward end 112 relative to the receptacle. Depressing the foot pedal forward end 112 downwardly by a user's foot will cause the foot pedal rearward end 114 to raise upwardly. This will push the link 24 upwardly through the recessed channel 44 in the housing rear wall 34, and cause the link top end 122 to press upwardly on the abutment flanges 88 of the lid 14. This in turn causes the lid 14 to pivot from its closed position covering over the top opening of the housing receptacle 12 to an opened position of the lid 14 where the lid is displaced from the receptacle top opening.

The support hoop 22 in the preferred embodiment of the invention is formed by a length of flexible, resilient wire 132 having opposite ends 134. The resilience of the hoop length 132 enables the opposite ends 134 of the hoop to be pulled away from each other, with the resilience of the hoop biasing the opposite ends 134 to their original positions. As seen in FIGS. 2 and 3, the length of the hoop 132 is bent in a curved configuration with the hoop opposite ends 134 bent inwardly from straight, intermediate portions 136 of the hoop. The inwardly bent opposite ends 134 of the hoop are received in the support holes 72 in the forward flange portions 68 of the receptacle 10. From the support holes 72, the straight intermediate portions 136 of the hoop extend forwardly. The hoop intermediate portions 136 extend parallel to each other along opposite outer sides of the forward flange portions 68 and pass through the forward flange notches 70. The hoop intermediate portions 136 are held securely in the forward flange notches 70. The curved portion of the support hoop 22 extends outwardly from the flange notches 70 in front of the receptacle housing 12 and around the forward end 112 of the foot pedal. The resilience of the hoop 22 solely holds the hoop opposite ends 134 in the support holes 72 in the intermediate flange portions 64. The engagement of the hoop ends 134 in the support holes 72 and the engagement of the hoop intermediate portions 136 in the flange notches 70 securely holds the support hoop 22 in a stationary position relative to the receptacle housing 12.

For packaging and shipping purposes, the hoop intermediate portions 136 can be pulled from the forward flange notches 70 and the hoop pivoted rearwardly to engage the hoop in the intermediate flange notches 74. This provides a compact assembly for packaging the receptacle 10.

In use of the receptacle 10, the support hoop 22 is positioned just above the surface on which the receptacle 10 is placed. On depressing the foot pedal 18 downwardly by a user's foot, the support hoop 22 will contact the surface supporting the receptacle 10 and stabilize the receptacle, preventing the receptacle from pitching forwardly toward the user as the user steps downwardly on the foot pedal 18.

The construction of the receptacle 10 described above provides a stabilized receptacle of a reduced number of component parts where tipping or rocking of the receptacle while the foot pedal is depressed in prevented.

Although the receptacle of the invention has been described above by reference to a preferred embodiment, it should be understood that other variations and modifications could be made to the receptacle without departing from the intended scope of protection provided by the following claims.

What is claimed is:

1. A stabilized receptacle comprising:

a receptacle housing having a bottom wall and at least one sidewall extending upwardly from the bottom wall to a top edge of the sidewall, the receptacle having an interior volume and a top opening to the interior volume;

a lid attached to the housing for movement of the lid between a closed position of the lid where the lid is positioned over the housing top opening and a opened position of the lid where the lid is displaced from the housing top opening;

a foot pedal attached to the housing for movement of the foot pedal between a lid closed position and a lid opened position of the food pedal relative to the housing; the foot pedal being operatively connected to the lid to cause the lid to move to the lid opened position in response to the foot pedal being moved to the lid opened position, and to cause the lid to move to the lid closed position in response to the foot pedal being moved to the lid closed position, the foot pedal having an end that projects outwardly from the receptacle;

a stabilizing hoop having opposite ends attached to the housing, the hoop having a length between the opposite hoop ends that extends outwardly from the housing and around the foot pedal end; and, the opposite hoop ends being attached to the housing for pivoting movement of the hoop length between an extended position of the hoop where the hoop extends outwardly from the housing and around the foot pedal end, and a retracted position of the hoop where the hoop length is positioned beneath the housing bottom wall.

2. The receptacle of claim 1, further comprising:

a pair of pivot holes in the housing and the opposite hoop ends being received in the pair of pivot holes for pivoting movement of the hoop.

3. The receptacle of claim 2, further comprising:

the hoop length having a flexibility and a resilience and the opposite hoop ends being held in the housing pivot holes solely by the hoop resilience.

4. A stabilized receptacle comprising:

a receptacle housing having a bottom wall and at least one side wall extending upwardly from the bottom wall to a top edge of the side wall, the receptacle having an interior volume and a top opening to the interior volume;

a lid attached to the housing for movement of the lid between a closed position of the lid where the lid is positioned over the housing top opening and opened position of the lid where the lid is displaced from the top opening;

a foot pedal attached to the housing for movement of the foot pedal between a raised position and a lowered position of the foot pedal relative to the housing;

a stabilizer hoop having an arched shape with opposite ends attached to the housing beneath the bottom wall and extending outwardly from beneath the housing beyond the foot pedal;

a link operatively connecting the foot pedal to the lid causing the lid to move from the closed position to the opened position in response to the foot pedal being moved from the raised position to the lowered position, and to allow the lid to move from the opened position to the closed position in response to the foot pedal moving from the lowered position to the raised position: and, the opposite ends of the hoop being attached to the housing for pivoting movement of the hoop.

5. The receptacle of claim 4, further comprising:

the hoop length having a pair of intermediate portions that are spaced from the hoop opposite ends and are also attached to the housing securing the hoop stationary to the housing.

6. The receptacle of claim 5, further comprising:

the hoop being a length of wire.

7. The receptacle of claim 5, further comprising:

the hoop being secured to the housing solely by the hoop opposite ends being attached to the housing and the hoop intermediate portions being attached to the housing.

8. A stabilized receptacle consisting essentially of:

a housing having a bottom wall and at least one sidewall extending upwardly from the bottom wall to a top edge of the side wall, the housing having an interior volume and a top opening to the interior volume adjacent the sidewall top edge;

a lid attached to the housing for movement of the lid between a closed position of the lid over the housing top opening and an opened position of the lid displaced from the housing top opening;

a pair of wheel assemblies attached to the housing;

a foot pedal attached to the housing for movement of the foot pedal between a raised position and a lowered position of the foot pedal relative to the housing;

a link connected to the foot pedal and the lid to cause the lid to move between the lid closed and lid opened positions in response to the foot pedal being in the respective raised and lowered positions;

a stabilizing hoop having opposite ends attached to the housing bottom wall, the hoop having a length between the hoop opposite ends that has an arched shape that extends outwardly from beneath the housing and around the foot pedal; and, the housing having a pair of holes; and, the hoop opposite ends are received in the pair of holes and attach the hoop to the housing.

9. The receptacle of claim 8, further comprising:

the hoop length being pivotable about the pair of holes in the housing.

10. The receptacle of claim 8, further comprising:

the hoop length having a flexible resilience that solely holds the hoop opposite ends in the pair of housing holes.

* * * * *